US005316441A

United States Patent [19]

Osborne

[11] Patent Number: 5,316,441

[45] Date of Patent: May 31, 1994

[54] MULTI-ROW RIB DIFFUSER

[75] Inventor: Colin Osborne, Norwich, Vt.

[73] Assignee: Dresser-Rand Company, Corning, N.Y.

[21] Appl. No.: 13,053

[22] Filed: Feb. 3, 1993

[51] Int. Cl.[5] ..... F04D 29/44; F04D 29/30

[52] U.S. Cl. ..... 415/208.4; 415/208.3

[58] Field of Search ..... 415/208.2, 208.3, 208.4

[56] References Cited

U.S. PATENT DOCUMENTS

| | | | |
|---|---|---|---|
| 3,069,070 | 12/1962 | Macaluso et al. . | |
| 3,861,826 | 1/1975 | Dean, Jr. . | |
| 4,054,398 | 10/1977 | Penny . | |
| 4,421,457 | 12/1983 | Yoshinaga et al. | 415/208.3 |
| 4,626,168 | 12/1986 | Osborne et al. | 415/208.3 |
| 4,850,795 | 7/1989 | Bandukwalla | 415/208.4 |
| 4,877,370 | 10/1989 | Nakagawa et al. | 415/208.4 |
| 4,877,373 | 10/1989 | Bandukwalla | 415/208.4 |
| 5,178,516 | 1/1993 | Nakagawa et al. | 415/208.3 |

FOREIGN PATENT DOCUMENTS

| | | |
|---|---|---|
| 58-101299 | 6/1983 | Japan . |
| 59-211798 | 11/1984 | Japan . |

*Primary Examiner*—Edward K. Look
*Assistant Examiner*—Michael S. Lee
*Attorney, Agent, or Firm*—Richards, Medlock & Andrews

[57] ABSTRACT

A multi-row rib diffuser is provided which comprises a first row of low ribs with relatively small height extending into regions of very low flow angle and a row of high ribs located behind the leading edge of the first row of ribs. The high ribs extend further into the region of the low flow angle and accept the connected flow from the low ribs as well as additional low angle flow not corrected by the low ribs.

10 Claims, 3 Drawing Sheets

MULTI-ROW RIB DIFFUSER

TECHNICAL FIELD OF THE INVENTION

This invention relates to diffusers for centrifugal compressors. In one aspect, it relates to such a diffuser with ribs.

BACKGROUND OF THE INVENTION

In a high specific speed centrifugal compressor with a vaneless diffuser, there is significant nonuniformity of the flow at the impeller exit in the passage defined by the vaneless diffusers. For radial discharge impellers, where the flow leaves the impeller 90° to the impeller axis in the meridional plane, this nonuniformity is generally characterized by a large region of low radial velocity and low angle flow, relative to the tangential, near the shroud side of the passage. There can also be a small amount of nonuniformity near the hub side. For mixed flow impellers, where the flow leaves the impeller at less than 90° to the impeller axis in the meridional plane, there is generally a redistribution of the nonuniformity in the direction of reducing the severity and extent of the nonuniformity near the shroud side of the passage and increasing the nonuniformity near the hub side.

There are several penalties associated with these flow nonuniformities if they are allowed to go unchecked. A low radial velocity fluid near the side walls of the vaneless diffuser will quickly be brought to rest and then pushed in towards the impeller by the increasing pressures within the diffuser. Thus, part of the flow is pushed back into the impeller where it has to be reprocessed. This leads to increased impeller work and decreased stage efficiencies. In addition, this reverse flow effectively blocks the passage in the vaneless diffuser, so that flow diffusion is diminished and efficiency suffers. The continued nonuniformity in the vaneless diffuser reduces the effectiveness and efficiency of the vaneless diffuser and downstream components.

The purpose of a rib diffuser is to correct the nonuniformity at the impeller tip by placing stationary ribs as near as practical to the impeller tip and only in regions having sufficiently low angle flow. This configuration avoids the problems associated with full vane diffusers which have vanes in the parts of the flow not requiring correction thus creating frictional and wake losses. Existing ideas attempt to correct the nonuniformity at the impeller tip by fixing a single row of ribs on the diffuser wall that extends across the complete region of low angle flow. The region of nonuniformity can be a significant percentage of the passage width at the impeller tip, and the flow angles can vary significantly over this region, up to 20°–30°. Consequently, a single row of ribs set at some average angle will see a large flow incidence variation, ±10°–15° or even ±20°, over the vane leading edge height. Incidence levels could be large enough to cause leading edge flow separation and/or significant boundary layer growth leading to flow losses and lower efficiencies.

Another existing idea attempts to correct nonuniformity of flow with the combination of a single row of ribs, a full vane and fins or grooves on the impeller. Because the full vane extends through areas of uniform flow, frictional and wake losses are incurred.

Thus, a need exists to more accurately correct and redirect the nonuniform flow regions without large flow incidence variations associated with single row rib diffusers and without additional frictional or wake losses associated with full vane diffusers.

SUMMARY OF THE INVENTION

The present invention provides a diffuser which corrects the nonuniform flow regions in a gradual and more efficient manner by having two or more rows of ribs extending into the nonuniform flow regions. A first row of low ribs of relatively small height is coupled as close as practical to the impeller. The height of these ribs is sufficient to capture only the more severely nonuniform flow near the wall with the advantage that the incidence range over the leading edge is relatively much smaller than a conventional rib diffuser. Further, the vane and flow angle change demanded in the first row is smaller than for a conventional rib diffuser. This is beneficial in terms of losses and efficiency. Subsequent second or more rows of high ribs of greater height than the low ribs accept the partially corrected flow from the low ribs and extend further into the nonuniform flow not corrected by the low ribs. By this unique configuration only areas of nonuniform flow are affected, and the nature of the successively increasing height of the ribs reduces the range of angle of incidence across the ribs' leading edges thus increasing efficiencies.

DETAILED DESCRIPTION

Figure 1:
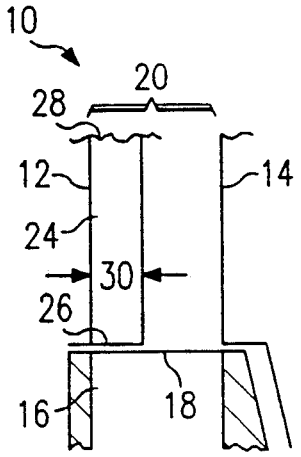
FIG. 1 (PRIOR ART)
FIG. 1 is a cross-sectional, meridional view of a prior art single row rib diffuser closely coupled to a radial flow impeller.

With reference to the accompanying figures, wherein like reference numerals designate like or corresponding parts throughout the several views, the present invention is explained hereinafter.

Figure 2:
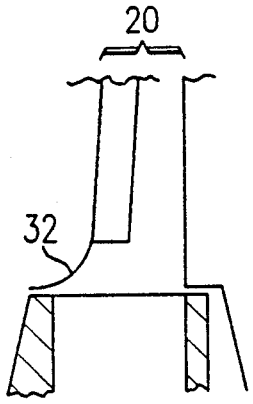
FIG. 2 (PRIOR ART)
FIG. 2 is a cross-sectional, meridional view of a prior art single row rib diffuser with a pinch region and retracted leading edge of the rib.

FIGS. 1 and 2 illustrate the configuration of the typical single row rib diffuser 10. Single row rib diffuser 10 is disposed around impeller 16 and closely coupled adjacent to impeller tip 18. Single row rib diffuser 10 has a shroud wall 12 and hub wall 14 which border flow passage 20. Single rib 24 extends from the shroud wall 12 into flow passage 20. Single rib 24 has leading edge 26 closely coupled to impeller tip 18.

Figure 3:
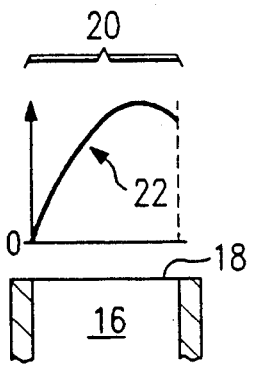
FIG. 3 is a flow profile of a radial flow impeller.
Figure 4:
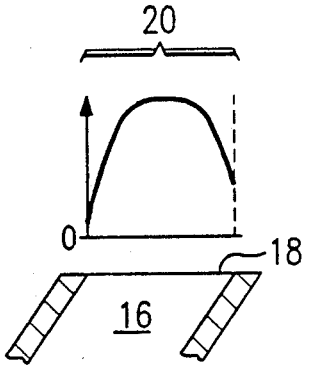
FIG. 4 is a flow profile of a mixed flow impeller.

FIGS. 3 and 4 show flow angle chart 22 superimposed over impeller tip 18 of impeller 16. Flow angle chart 22 depicts the meridional flow angle varying across the width of the flow. Thus, with the radial flow impeller of FIGS. 1 and 3, low angle flow appears close to the, shroud wall 12 of diffuser 10. FIG. 4 shows low angle flow at both the shroud wall 12 and hub wall 14 for the mixed flow impeller 16. With reference back to FIGS. 1 and 2, it can be seen that single rib 24 is arranged to extend into the regions of low angle flow.

The disadvantage for these typical diffusers is that leading edge 26 extends across a significant range of flow angle as can be seen when comparing FIG. 1 to flow angle chart 22 of FIG. 3. For practical reasons rib 24 is two-dimensional in that the angle of leading edge 26 relative to shroud wall 12 is substantially constant. Consequently, these two-dimensional single ribs are set at some average angle. Due to the variation of the low angle flow as illustrated by the steepness of the flow angle line in chart 22, the average angle of leading edge 26 will see a large range of flow incidence, sometimes up to +20% over the height 30 of leading edge 26. These incidence levels can be large enough to cause leading edge flow separation and/or significant boundary layer growth leading to flow losses and lower efficiencies.

Figure 5:
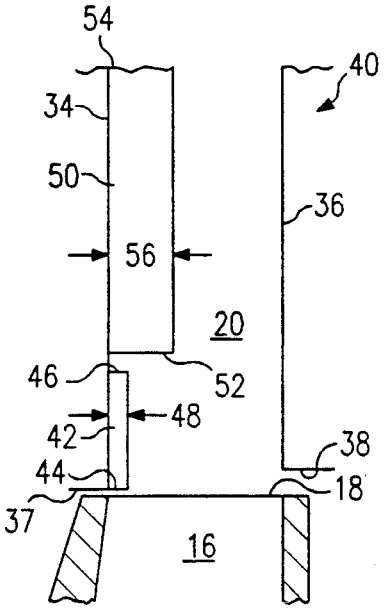
FIG. 5 is a cross-sectional, meridional view of the preferred embodiment of the multi-row rib diffuser of the present invention.
Figure 6:
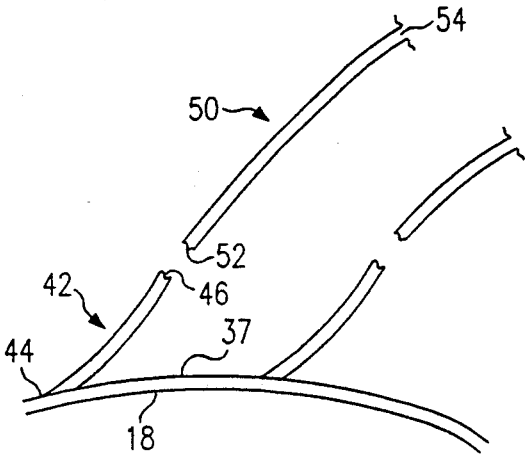
FIG. 6 is an axial view of the preferred embodiment of the multi-row rib diffuser of the present invention.

FIGS. 5 and 6 illustrate the preferred embodiment of the present invention which provides two rows of ribs to better match the range of flow incidence thus reducing flow losses and increasing efficiencies. Multi-row rib diffuser 40 is coupled around impeller 16 and its impeller tip 18. First wall 34 and second wall 36 border flow passage 20. First wall 34 and second wall 36 have upstream end 37 and 38 respectively proximal impeller tip 18. A row of low ribs 42 is coupled as closely as practical to impeller tip 18 in the preferred embodiment and is of relatively low rib height 48. Low rib height 48 is sufficient to extend into only the more severely nonuniform flow, or in other words, the lowest angle flow near the wall. The low height of the row of low ribs 42 provides the advantage that the incidence range over low rib leading edge 44 is relatively much smaller than for a rib in a conventional rib diffuser. Negligible flow separation and boundary layer growth will occur with the row of low ribs 42 unlike the larger conventional single row diffuser. A row of high ribs 50 with high rib leading edge 52 and high rib trailing edge 54 is located behind the low rib trailing edge 46 of row of low ribs 42. The row of high ribs 50 accepts the partially corrected flow from the row of low ribs 42 and more of the nonuniform flow further away from first wall 34. The high rib height 56 of the row of high ribs 50 is greater than low rib height 48 of the row of low ribs 42. Because the row of low ribs 42 has corrected the lowest angle flow, the row of high ribs 50 now confronts a narrower range of angle flow incidence than it would have without the row of low ribs 42. This narrow range flow incidence contributes to reduced losses and greater efficiencies.

FIG. 6 illustrates an axial view of the preferred embodiment of the multi-row rib diffuser. High rib leading edge 52 of the row of high ribs 50 is aligned directly behind the low rib trailing edge 46 of the row of low ribs 42. Low rib leading edge 44 is coupled as close as practicable to impeller tip 18.

It should be understood that FIG. 6 is the preferred arrangement and that various alternatives can be used to reduce losses and increase efficiencies. More than two rows of ribs with increasingly greater heights can be employed although two is preferred. Successively higher ribs extend further into regions of low angle flow to correct the flow, yet have minimal flow incidence variation across their leading edge due to the previously lower row having corrected the lower range of low flow. At the same time, frictional and wake losses are kept to a minimum because no ribs or vanes extend into areas of uniform flow not requiring correction.

Figure 7:
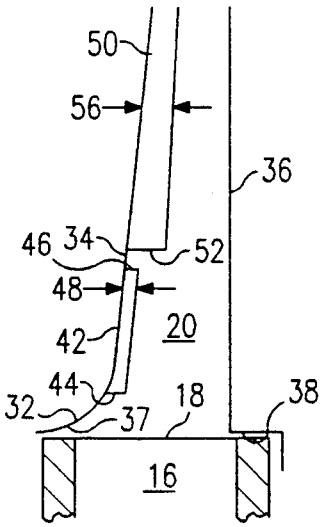
FIG. 7 is a cross-sectional, meridional view of an alternative embodiment of the multi-row rib diffuser of the present invention with shroud pinching.

With reference to FIG. 7, an alternative embodiment of the present invention is shown. Pinch region 32 is shown in the first wall 34 of the multi-row rib diffuser 40. In this embodiment, the first row of ribs can be placed after the pinch with the low rib leading edge 44 retracted. It should be understood that the rows of ribs can be on just the first wall, just the second wall, or both. Likewise, the pinch can be on one side or both. Also, the first wall and second wall can be parallel, divergent, or convergent, and the top of the ribs can be parallel or angled with respect to the flow. The rows of ribs on the same wall or on opposite walls can be offset circumferentially with respect to one another as well as being in line with each other as illustrated in FIG. 6. The height of each blade row is a function of the flow angle distribution like illustrated in flow angle chart 22. The combined height of rib rows located at the same or nearly the same circumferential position on the first and second walls are such that they do not touch.

Figure 8:
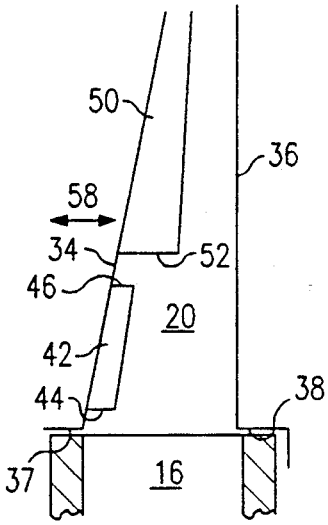
FIG. 8 is a cross-sectional, meridional view of an alternative embodiment of the multi-row diffuser of the present invention with a movable wall.

With reference to FIG. 8, the present invention can also be used where the diffuser has one or both walls designed to be movable. Movable wall 58 contains first row of ribs 42 and second row ribs 50.

Figure 9:
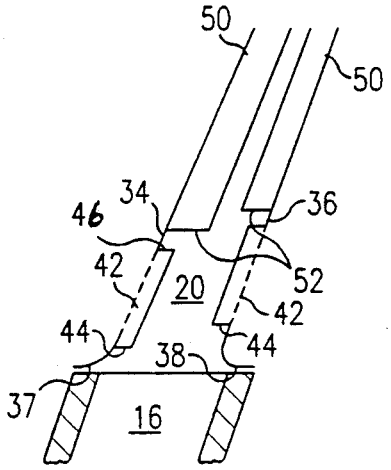
FIG. 9 is a cross-sectional, meridional view of an alternative embodiment of the multi-row diffuser of the present invention for a mixed flow impeller.

FIG. 9 shows the present invention used with a mixed flow impeller. FIG. 9 also illustrates rows of low and high ribs on the first and second walls.

Figure 10:
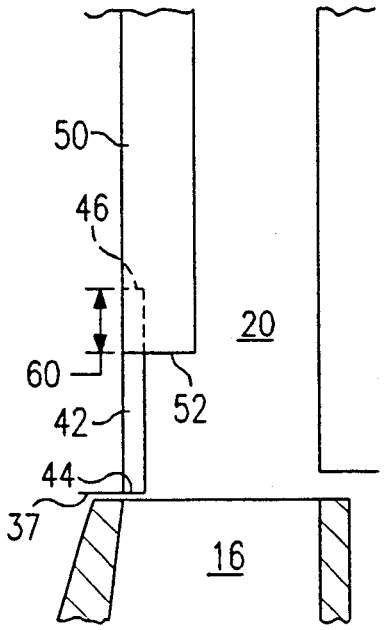
FIG. 10 is a cross-sectional, meridional view of an alternative embodiment of the multi-row diffuser of the present invention.
Figure 11:
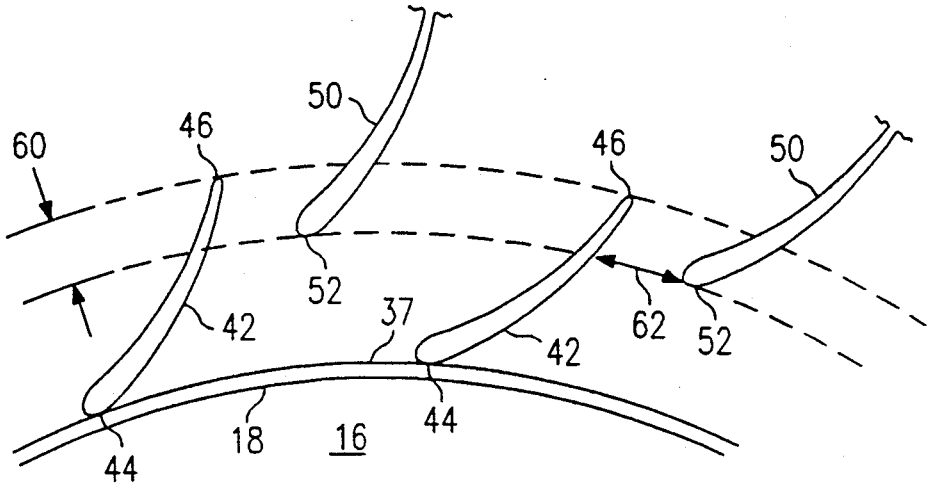
FIG. 11 is an axial view of the diffuser of FIG. 10.

In an alternative embodiment, shown in FIGS. 10–11, low ribs 42 are circumferentially offset from high ribs 50, and trailing edge 46 of low rib 42 extends radially beyond leading edge 52 at high rib 50. The amount of overlap region 60 as well as the circumferential offset 62 can be varied for the desired effect. Again, the arrangement shown in FIGS. 10–11 can be used on one wall or both walls, on fixed or moving walls, on pinched or non-pinched, and either circumferentially aligned with an arrangement on the opposite wall or not. The benefit of this overlap arrangement is that it is another configuration variable that can be varied to develop the optimum configuration for a given application.

The present invention serves to correct the severe low angle flow that occurs at the shroud wall of a radial flow impeller or the shroud and hub walls of a mix flow impeller by placing a relatively small height first row of low ribs extending into the extreme low flow angle region. If only the row of low ribs is used, a large region of low flow angle is still left uncorrected. The present invention then provides a second or more row of ribs to be placed behind the first row of low ribs to extend into the additional region of low flow angle to correct such flow. If only the second row of ribs was used without the first row of low ribs, a large variance of flow angle would occur across the leading edge of the second row of ribs creating flow losses and lowering efficiencies. However, with the first row of low ribs, the extremely low flow is corrected and thus the leading edge of the second row of high ribs then faces a smaller range of flow variance which contributes to reduced flow losses and greater efficiencies.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A vaneless diffuser for correcting nonuniform flow exiting radially from an impeller, the nonuniform flow being characterized by a rate of flow that is lowest at one side and increases towards the middle of the flow, said diffuser comprising:

(a) a housing attachable around the impeller and defining a passage for receiving the nonuniform flow exiting from the impeller, the passage extending radially from the impeller and defined between a first wall for bordering the side of the nonuniform flow that has the lowest rate of flow and a second wall for bordering the other side of the nonuniform flow, said first wall and said second wall having an upstream end proximal the impeller when the housing is attached around the impeller, the passage having no structure that extends across it from the first wall to the second wall;

(b) a plurality of low ribs extending from said first wall partially into said passage and arranged around said upstream end in a first pattern for partially correcting a portion of the low flow, each of said plurality of low ribs having a low rib leading edge towards said upstream end of said first wall and a low rib trailing edge opposite of and downstream of the leading edge; and (c) a plurality of high ribs extending from said first wall into said passage further than said plurality of low ribs but less than the distance to the second wall and arranged in a second pattern that is concentric with the first pattern of said plurality of low ribs for correcting the low flow downstream of said low rib leading edges, each of said plurality of high ribs having a high rib leading edge towards said upstream end of said first wall.

2. The diffuser of claim 1 wherein said high rib leading edges are downstream from said low rib trailing edges.

3. The diffuser of claim 1 wherein there is a corresponding high rib for each low rib.

4. The diffuser of claim 1 wherein said high rib leading edges are aligned with said low rib trailing edges.

5. The diffuser of claim 1 wherein there are more high ribs than low ribs.

6. A vaneless diffuser for correcting nonuniform flow exiting radially and axially from an impeller, the nonuniform flow being characterized by a rate of flow that is lowest at each side and increases towards the middle of the flow, said diffuser comprising:

(a) a housing attachable around the impeller and defining a passage for receiving the nonuniform flow exiting from the impeller, said housing having a first wall for bordering one side of the nonuniform flow and a second wall for bordering the other side of the nonuniform flow, said first wall and said second wall having an upstream end proximal the impeller when the housing is attached around the impeller, the passage having no structure that extends across it from the first wall to the second wall;

(b) a fist plurality of low ribs extending from said first wall partially into said passage and arranged around said upstream end of said first wall in a first pattern for partially correcting a portion of the low flow bordered by said first wall, each of said first plurality of low ribs having a low rib leading edge towards said upstream end of said first wall and a low rib trailing edge opposite of and downstream of the leading edge;

(c) a second plurality of low ribs extending from said second wall partially into said passage and arranged around said upstream end of said second wall in a second pattern for partially correcting a portion of the low flow bordered by said second wall, each of said second plurality of low ribs having a low rib leading edge towards said upstream end of said second wall and a low rib trailing edge opposite of and downstream of the leading edge;

(d) a first plurality of high ribs extending from said first wall into said passage further than said first plurality of low ribs but less than the distance to the second wall and arranged in a third pattern that is concentric with the first pattern of said first plurality of low ribs for correcting the low flow downstream of said low rib lading edges of said first plurality of low ribs, each of said first plurality of high ribs having a high rib leading edge towards said upstream end of said first wall; and (e) a second plurality of high ribs extending from said second wall into said passage further than said second plurality of low ribs but less than the distance to the first wall and arranged in a fourth pattern that is concentric with the first pattern of said second plurality of low ribs for correcting the low flow downstream of said low rib leading edges of said second plurality of low ribs, each of said second plurality of high ribs having a high rib leading edge towards said upstream end of said second wall.

7. The diffuser of claim 6 wherein said high rib leading edges are downstream from said low rib trailing edges.

8. The diffuser of claim 6 wherein there is a corresponding high rib for each low rib.

9. The diffuser of claim 6 wherein said high rib leading edges are aligned with said low rib trailing edges.

10. The diffuser of claim 6 wherein there are more high ribs than low ribs.

* * * * *